United States Patent [19]

McVeagh

[11] Patent Number: 4,798,145

[45] Date of Patent: Jan. 17, 1989

[54] HOLLOW CHARGE AND LINER ASSEMBLAGE

[75] Inventor: John S. McVeagh, Seaview, England

[73] Assignee: The Secretary of State for Defence in Her Britannic Majesty's Government of the United Kingdom, London, England

[21] Appl. No.: 450,439

[22] Filed: Dec. 3, 1982

[30] Foreign Application Priority Data

Dec. 8, 1981 [GB] United Kingdom ..... 8136923

[51] Int. Cl.[4] ..... F42B 11/22

[52] U.S. Cl. ..... 102/476; 102/306

[58] Field of Search ..... 102/306, 307, 309, 475, 102/476, 701; 86/20 B

[56] References Cited

U.S. PATENT DOCUMENTS 4,365,556 12/1982 Reibel ..... 102/309

FOREIGN PATENT DOCUMENTS 1946990 3/1971 Fed. Rep. of Germany ..... 102/476
2008157 11/1978 Fed. Rep. of Germany ..... 102/476
578845 7/1946 United Kingdom .
625333 6/1949 United Kingdom .
645611 11/1950 United Kingdom .
722646 1/1955 United Kingdom .
940705 10/1963 United Kingdom .
1432627 4/1976 United Kingdom .
2029941 3/1980 United Kingdom .

*Primary Examiner*—Harold J. Tudor
*Assistant Examiner*—Richard Klein
*Attorney, Agent, or Firm*—Cushman, Darby & Cushman

[57] ABSTRACT

An assemblage which forms part of a warhead of other explosive device which seeks to overcome the problem of charge/liner detachment caused by excessive shrinkage of charge volume under low ambient temperature conditions and set-back during high acceleration launches.

A container comprising a hollow charge liner peripherally attached to a rearwardly extended tubular sleeve contains a charge assemblage that is in contact with the liner and has a rearwardly extended portion protrusive beyond the sleeve. The container is slideable within the casing. A short waisted cylindrical spring washer is disposed within the casing so as to urge the container rearward relative to the case thereby axially compressing the charge assemblage between the liner and the rear end of the casing.

10 Claims, 3 Drawing Sheets

HOLLOW CHARGE AND LINER ASSEMBLAGE

This invention relates to means by which a hollow charge and its associated liner may be anchored within a casing. In particular but not exclusively the invention is applicable to a warhead for a rocketpropelled projectile.

Warheads are known wherein a cylindrical explosive charge having a cavity in a forward axial face is loaded into a tubular outer casing of the warhead and a liner is secured in intimate contact with the cavity by permanent attachment to the casing at a predetermined axial location. The charge is rigidly held in place in a space within the warhead which is essentially of constant volume. Close matching of the charge/liner interface, herein referred to as "shock impedance matching", is essential for maximum conversion of charge explosion energy to target penetration energy. Any minor dimensional discrepancies between the charge and the liner can be taken up by, for example, a felt pad soaked in paraffin wax which is inserted while soft between the rear of the charge and the casing so that when the wax hardens the charge is firmly held against the liner.

A disadvantage of this method of assembly is that when the warhead is subjected to high duty cycling of temperature such as is found in arctic and desert regions, where the ambient temperature varies considerably over relatively short periods of time, the hollow charge may become partly or completely detached from the liner. This charge detachment is due to the explosive charge material normally having a much higher co-efficient of thermal expansion than that of the casing and liner so that at low ambient temperatures the charge tends to shrink relative to its enclosing space. High duty cycling of temperature tends to worsen the problem as continuous expansion and contraction will increase the probability of charge detachment from the liner.

A further disadvantage of this method of assembly becomes manifest when used in a warhead that is subjected to a high acceleration during launch. In such a warhead the explosive charge experiences set-back which, again, can result in the charge becoming detached from the liner.

Detachment of the charge from its liner disturbs the shock impedance matching of the interface since irregular air gaps are introduced which can act both to cause asymmetric disturbance of shock wave patterns and to diminish the velocity of the resulting target penetration elements.

It is an object of the present invention to provide a hollow charge and liner assemblage which is more able to accommodate charge shrinkage.

Accordingly, a hollow charge and liner assemblage includes a tubular casing having a closed rear end and an open front end;

a hollow charge container slideable within the casing comprising a hollow charge liner peripherally attached to a rearwardly extended tubular sleeve;

a charge assemblage contained within the container having an explosive charge in contact with the liner and a rearwardly extended portion protrusive beyond the sleeve; and a compression means located within the casing forward of the container and operative between the container and the casing so as to urge the container rearwardly relative to the casing thereby axially compressing the charge assemblage between the liner and the rear end of the casing.

Preferably the explosive charge is cast directly into the charge container after coating the container with a mould release agent so as to prevent adherence of the casting to the sides of the container when the explosive charge has set. The rearwardly extended portion of the charge assemblage may be a simple extension of the explosive charge casting or may be formed by part, or the whole, of a detonating means.

The compression means is preferably a spring washer symmetrically disposed about the longitudinal axis of the casing and axially loaded against the peripheral circumference of the container. The washer is preferably set sufficiently far forward of the liner to allow target penetration elements formed from the liner after detonation of the explosive charge a substantially unrestricted passage through its centre.

The anchorage of the spring within the casing is conveniently achieved by spring-loaded hardened metal teeth tangentially arranged about a forward peripheral circumference of the spring and forwardly divergent from the axis. The spring may conveniently be inserted rearwardly into the casing against the container by a powered insertion means. On release of the insertion means the teeth penetrate the softer material of the casing when forced forward by the spring attempting to retain its original shape. The spring is thus held in compression between the container and the casing.

The spring is advantageously designed such that it exerts a load evenly distributed above the peripheral circumference of the container which load will remain positive and significant, but not excessive, throughout the range of movements resulting from differential thermal expansion over the range of environmental temperatures which the charge is designed to withstand and during set-back at the launch of the warhead.

An embodiment of the present invention will now be described by way of example only with reference to the accompanying drawings of which FIG. 1 is a simplified part sectional view of a conventional hollow charge warhead assembled at room temperature;

Figure 1:
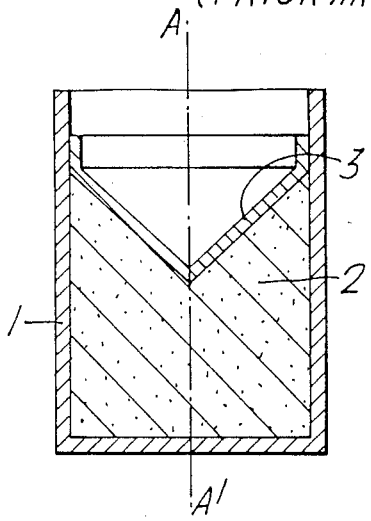
Fig. 1. (PRIOR ART)
Figure 2:
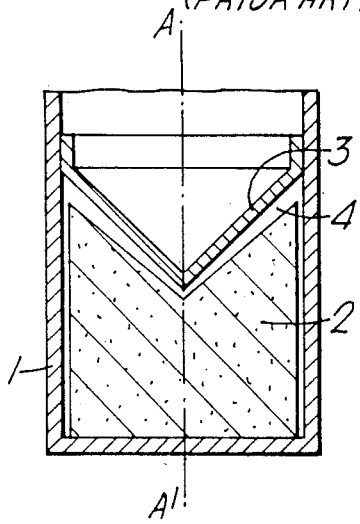
Fig. 2. (PRIOR ART)
FIG. 2 illustrates in part sectional view one effect of low ambient temperature conditions on the warhead illustrated in FIG. 1.
Figure 3:
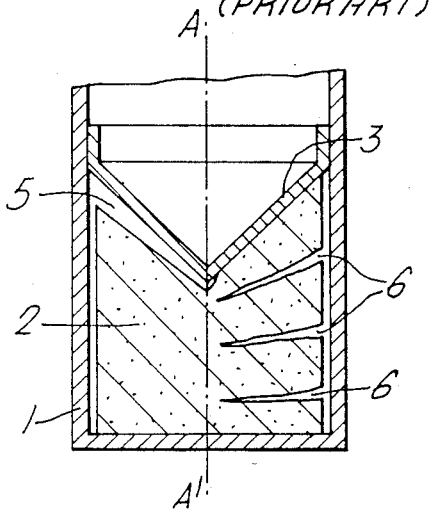
Fig. 3. (PRIOR ART)
FIG. 3 illustrates in part sectional view a second effect of low ambient temperature conditions on the warhead illustrated in FIG. 1.

The warhead partly illustrated in FIGS. 1, 2 and 3 comprises a rearwardly closed tubular casing 1 with a fore and aft axis AA' containing a hollow charge 2 of explosive material backing an associated conical liner 3. The liner 3 is peripherally attached to the casing 1. FIG. 1 illustrates the warhead as assembled at room temperature with a charge 2 fitted, to acceptable engineering tolerances, within the casing 1 behind the liner 3.

In FIG. 2, due to the low ambient temperature conditions to which the warhead is subjected and the relatively high co-efficient of thermal expansion of the charge 2, the charge 2 has decreased considerably in volume relative to the casing 1 and the liner 3. One of the effects of this shrinkage is illustrated here. The charge 2 has come away from the liner 3 cleanly and symmetrically leaving a gap 4. The presence of the gap 4 impairs the shock impedance matching between the charge 2 and the liner 3 and consequently degrades warhead performance.

A second effect of the reduction in volume of the charge 2 is illustrated in FIG. 3. Partial adherence of the charge 2 to the liner 3 and the casing 1 has led to an asymmetrical air gap 5 being formed between the charge 2 and the liner 3 and fissures 6 being opened up in the charge 2 itself. The fissures 6 and the asymmetrical air gap 5 tend to disrupt seriously the formation of target penetration elements (not shown) from the liner 3 on detonation of the charge 2.

Figure 4:
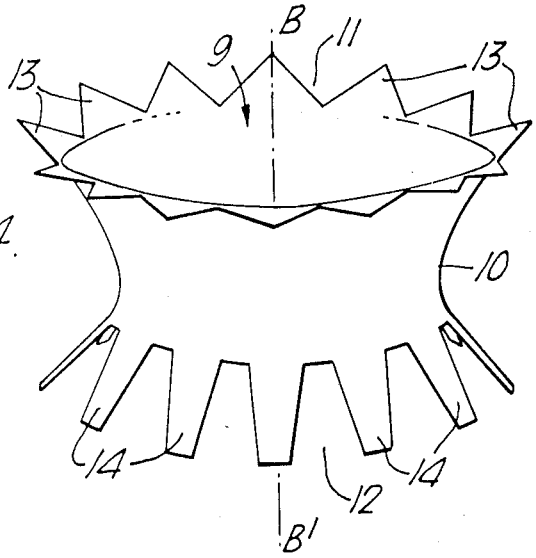
FIG. 4 is a three-dimensional schematic representation of a circular spring washer compression means for use in the embodiment of the present invention illustrated in FIG. 5.
Figure 5:
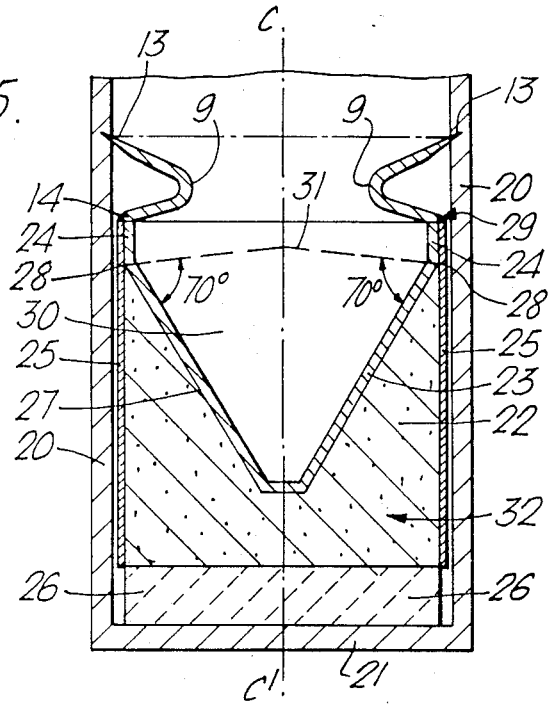
FIG. 5 is a part sectional view of a lined hollow charge warhead assembled at room temperature and including the circular spring washer illustrated in FIG. 5.
Figure 6:
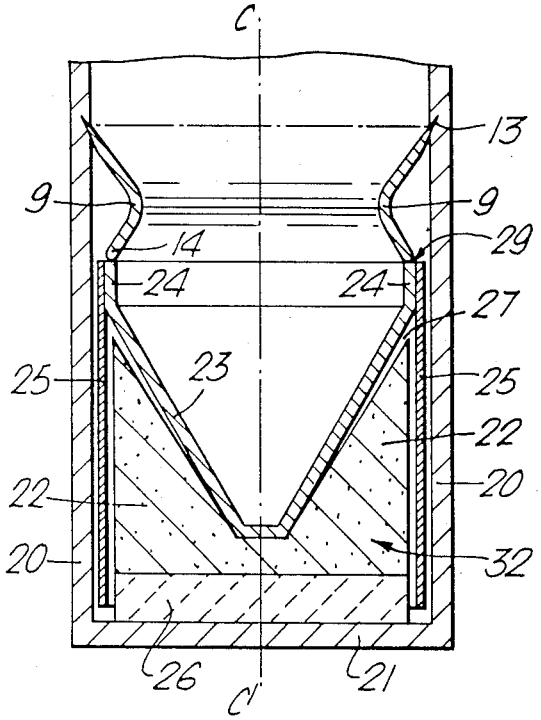
FIG. 6 is a part sectional view of the warhead illustrated in FIG. 5 when subjected to a low ambient temperature.

An embodiment of the present invention is shown in FIGS. 5 and 6. It employs the spring washer compression means 9 illustrated in FIG. 4.

The washer 9 comprises a short, waisted cylindrical tube 10 of thin tempered stainless steel plate with a fore and aft axis BB'. The tube 10 has a forward end 11 and a rearward end 12 each transversely disposed with respect to the axis BB'. The forward end 11 of the tube 10 is formed into a multiplicity of forwardly divergent flexible saw teeth 13 tangentially arranged and regularly spaced about the axis BB'. The rearward end 12 of the tube 10 is formed into a multiplicity of rearwardly divergent flexible tapered tabs 14 tangentially arranged and regularly spaced about the axis BB' such that the peripheral diameter of the rearward end 12 is slightly less than the peripheral diameter of the forward end 11. The teeth 13, the tabs 14, and waisted shape of the tube 10 all contribute an axial elasticity to the tube 10. Spring washers of this type are commercially available under the name of "SPIRE Retaining Clip" as manufactured by Forrest Fasteners Limited, of Treforest, Pontypridd, Glamorgan, Wales.

The warhead illustrated in FIG. 5 has a tubular casing 20 of aluminium with a fore and aft axis CC' rearwardly closed by a planar metal barrier 21 transversely disposed with respect to the axis CC'. Forward of the barrier 21 and co-axial with the axis CC' rests a charge assemblage 32 comprised by a detonating means 26 adjacent the barrier 21 and a cylindrical explosive charge 22 forward of the detonating means 26 having a hollow, conical forward face 27 with a forward circular base 28 which forward face 27 is in intimate contact with a conical metal liner 23. The apex angle of the forward face 27 illustrated in FIG. 5 is 60° but the invention is equally applicable to other similar hollow charge and liner assemblages in which the apex angle of the forward face 27 lies between 40° and 65°. The liner 23 includes a forward short cylindrical base portion 24 about whose periphery is firmly attached a co-axial tubular metal sleeve 25 to form a container 29 into which the explosive charge 22 was cast prior to assembly. The detonating means 26 extends rearwardly beyond the sleeve 25 by an amount sufficient to accommodate the anticipated axial shrinkage of the charge 22. Sufficient clearance exists between the sleeve 25 and the casing 20 to allow free axial movement of the container 29 within the casing 20 and to allow the rearward passage of warhead fuze wires (not shown) connecting a fuzing system (not shown) disposed forward of the charge 22 to the detonating means 26.

The washer 9 is disposed co-axially with the axis CC' within the casing 20 forward of the container 29. The forwardly divergent teeth 13 are partly embedded on the casing 20 anchoring the washer 9 with respect to forward motion and at an axial location which provides that the peripheral contact of the tabs 14 against the container 29 acts to hold the washer 9 in axial compression. The washer 9 thus urges the container 29 rearwardly relative to the casing 20 thereby axially compressing the charge 22 between the liner 23 and the barrier 21.

The base portion 24 is of sufficient axial length to prevent the washer 9 encroaching into a volume 30 within the liner 23 defined to the rear by the liner 23 and to the fore by an imaginary inverted cone 31 disposed in axial alignment with respect to the liner 23 such that it forms an intersection angle of at least 70° with the liner 23 adjacent the forward circular base 28. This volume 30 is kept clear to minimise interference by the washer 9 with target penetration elements (not shown) formed from the liner 23 on detonation of the hollow charge 22.

FIG. 6 illustrates the typical shrinkage that will occur when the warhead of FIG. 5 is subjected to low temperatures. As an example, the warhead may be assembled at an ambient room temperature of 15° C. but the minimum ambient temperature conditions to which the warhead may be subjected is typically −40°. The hollow charge 22 having a much higher co-efficient thermal expansion than that of the casing 20, the barrier 21 and the container 29 is significantly reduced in volume and occupies a relatively small space in the warhead. The axial contraction of the charge 22 is substantially taken up by movement of the container 29 urged rearward by the spring washer 9 to leave a space 27 between the charge 22 and the liner 23 which is significantly smaller in volume and of greater symmetry than it would be if the liner 23 had been rigidly attached to the casing 20. An insertion force of 30 kg for a 100 mm diameter washer 9 has been found sufficient to ensure that the container 29 is urged rearward by the spring washer 9 as described above.

I claim:

1. A hollow charge and liner assemblage including:

a tubular casing having a closed rear end and an open front end;

a hollow charge container slideable within the casing comprising a hollow charge liner peripherally attached to a rearwardly extended tubular sleeve;

a charge assemblage contained within the container including an explosive charge having a hollow forward face in contact with the liner, and a rearwardly extended portion protrusive beyond the sleeve; and a compression means located within the casing forward of the container and operative between the casing and the container so as to urge the container rearwardly relative to the casing thereby axially compressing the charge assemblage between the liner and the rear end of the casing.

2. A hollow charge and liner assemblage as claimed in claim 1 wherein the compression means is peripherally engaged with the container.

3. A hollow charge and liner assemblage as claimed in claim 2 wherein the compression means comprises a spring washer.

4. A hollow charge and liner assemblage as claimed in claim 3 wherein the spring washer comprises a waisted cylindrical tube co-axial with the casing having a forwardly divergent portion engaged with the casing and a rearwardly divergent portion engaged with the container.

5. A hollow charge and liner assemblage as claimed in claim 4 wherein the spring washer is substantially harder than the casing.

6. A hollow charge and liner assemblage as claimed in claim 5 wherein the forwardly divergent portion of the spring washer comprises a multiplicity of flexible saw teeth embedded in the tubular casing and the rearwardly divergent portion comprises a multiplicity of flexible tabs compressively engaged with the container.

7. A hollow charge and liner assemblage as claimed in claim 6 wherein the hollow forward face is axially symmetrical with respect to the casing.

8. A hollow charge and liner assemblage as claimed in claim 7 wherein the hollow forward face is conical having a forward circular base.

9. A hollow charge and liner assemblage as claimed in claim 8 wherein the compression means is wholly disposed forward of a volume within the liner defined to the rear by the liner and to the fore by an imaginary inverted cone axially aligned with respect to the liner such that the inverted cone forms an intersection angle of at least 70° with the liner adjacent to the forward circular base.

10. A hollow charge and liner assemblage as claimed in claim 9 wherein the hollow forward face has an apex angle which is between 40° and 65°.

* * * * *